US007278824B2

(12) United States Patent
Mordue et al.

(10) Patent No.: US 7,278,824 B2
(45) Date of Patent: Oct. 9, 2007

(54) PUMP FOR MOLTEN MATERIALS WITH SUSPENDED SOLIDS

(75) Inventors: George S. Mordue, Ravenna, OH (US); Mark A. Bright, Cleveland Heights, OH (US)

(73) Assignee: Pyrotek, Inc., Solon, OH (US)

( * ) Notice: Subject to any disclaimer, the term of this patent is extended or adjusted under 35 U.S.C. 154(b) by 124 days.

(21) Appl. No.: 11/011,802

(22) Filed: Dec. 14, 2004

(65) Prior Publication Data

US 2005/0100440 A1 May 12, 2005

Related U.S. Application Data

(62) Division of application No. 10/403,954, filed on Mar. 31, 2003, now Pat. No. 6,843,640, which is a division of application No. 09/775,401, filed on Feb. 1, 2001, now Pat. No. 6,551,060.

(60) Provisional application No. 60/178,913, filed on Feb. 1, 2000.

(51) Int. Cl.
*F04D 29/44* (2006.01)

(52) U.S. Cl. ..... 415/213.1; 416/228

(58) Field of Classification Search ..... 415/213.1, 415/121.2, 169.1, 200, 206; 416/228, 231 R
See application file for complete search history.

(56) References Cited

U.S. PATENT DOCUMENTS

| | | | | |
|---|---|---|---|---|
| 3,048,384 | A | 8/1962 | Sweeney et al. | |
| 3,255,702 | A | 6/1966 | Gehrm | |
| 3,984,234 | A | 10/1976 | Claxton et al. | |
| 4,426,068 | A | 1/1984 | Gimond et al. | |
| 4,786,230 | A | 11/1988 | Thut | |
| 5,092,821 | A | 3/1992 | Gilbert | |
| 5,330,328 | A | 7/1994 | Cooper | |
| 5,622,481 | A | 4/1997 | Thut | |
| 5,634,770 | A | 6/1997 | Gilbert et al. | |
| 5,685,701 | A | 11/1997 | Chandler et al. | |
| 6,113,363 | A | 9/2000 | Talaski | |
| 6,354,796 | B1 * | 3/2002 | Morando | 415/121.2 |
| 6,358,467 | B1 | 3/2002 | Mordue | |
| 6,439,860 | B1 * | 8/2002 | Greer | 417/360 |
| 6,451,247 | B1 * | 9/2002 | Mordue et al. | 266/239 |
| 6,457,940 | B1 | 10/2002 | Lehman | |

* cited by examiner

*Primary Examiner*—Igor Kershteyn
(74) *Attorney, Agent, or Firm*—Fay Sharpe LLP

(57) ABSTRACT

A molten material pump includes an impeller housed within a base member of the pump. A plurality of grooves are defined in a peripheral sidewall of the impeller for either drawing a molten material into the base member's chamber or pushing molten material out of the base member's chamber. The impeller is rotated by a rotatable shaft connected to an upper surface of the impeller. The rotatable shaft includes a non-circular shaped lower end dimensioned to be received within a cooperating opening in the impeller. The molten material pump further includes a connecting assembly for interconnecting components of the molten material pump. The connecting assembly includes a first mounting member attached to a first pump component that is dimensioned to be fitted within a cooperating recess of a second mounting member attached to a second pump component. In another embodiment of the invention, a stub shaft connects an upper shaft portion of the shaft to the impeller. The stub shaft includes a universal joint that is not rigidly connected to the upper shaft portion. In addition, the universal shaft is configured to allow the stub shaft and impeller to pivot. A floating deflector block weighs on an upper sealing block of the pump for enhancing the seal at the pump's bearing surfaces.

8 Claims, 8 Drawing Sheets

PUMP FOR MOLTEN MATERIALS WITH SUSPENDED SOLIDS

CROSS-REFERENCES TO RELATED APPLICATIONS

This application is a divisional continuation of prior application Ser. No. 10/403,954, filed Mar. 31, 2003 now U.S. Pat. No. 6,843,640, which was a divisional continuation of application Ser. No. 09/775,401, filed Feb. 1, 2001, now U.S. Pat. No. 6,551,060, which claims benefit of provisional application Ser. No. 60/178,913, filed Feb. 1, 2000 incorporated herein by reference.

BACKGROUND OF THE INVENTION

1. Field of the Invention

This invention relates generally to the art of processing and treating molten metal, molten alloys, molten salts, or any other molten materials (hereinafter collectively referred to as "molten materials").

2. Discussion of the Art

In the course of processing molten materials, it is often necessary to transfer the molten materials from one vessel to another or to circulate the molten materials within a vessel. Pumps for processing molten materials are commonly used for these purposes. The pumps can also be used for other purposes, such as to inject purifying gases into the molten materials being pumped. A variety of pumps as described are available from Metallic Systems Co., L.P., 31935 Aurora Road, Solon, Ohio 44139.

In the case where a molten material is melted in a reverbatory furnace, the furnace is typically provided with an external well in which a pump is disposed. When it is desired to remove molten materials from the vessel, a transfer pump is used. When it is desired to circulate molten materials within the vessel, a circulation pump is used. When it is desired to modify molten materials disposed within the vessel, a gas injection pump is used.

In each of these pumps, a rotatable impeller is disposed within a cavity or housing of a base member that is immersed in a molten material. Upon rotation of the impeller, the molten material is pumped through an outlet or discharge opening and processed in a manner dependent upon the type of pump being used. The impeller itself is supported for rotation in the base member by means of a rotatable shaft. The shaft is rotated by a motor provided at the shaft's upper end. Several support posts extend from a motor support platform to the base member for supporting and suspending the base member within the molten material. In addition, risers may extend upward from the base member for providing a path or channel for the molten materials to exit through.

Although pumps of the foregoing type have been in effective operation for several years, they still suffer from a variety of shortcomings. For example, graphite or ceramic (i.e. refractory materials) are typically the materials used for constructing many of the components of pumps used for processing molten materials because of its low cost, relative inertness to corrosion, and its thermal shock resistance. Although graphite has advantages when used for certain components of molten material pumps, it is not the most advantageous material to be used for complicated shapes and mechanically stressed components.

Rather, it is preferable to make these types of components, e.g. support posts, risers and rotating shafts, from a metallic material, such as iron based alloys or steel, since metallic materials are considerably stronger per pound than graphite. The problem with using these materials is that the base member and impeller are typically constructed from graphite (due to its wear characteristics) and it is difficult to maintain a connection between metallic and graphite components. Such a difficulty arises because of the differences in thermal expansion experienced by these materials. Accordingly, bolts and conventional fasteners are generally not feasible connecting mechanisms. Moreover, the simplest connection would be for the metallic shaft to include a circular threaded male member which is configured to be received within a threaded female member of the graphite impeller.

A second problem arises in connection with attaching a metallic shaft to a graphite impeller. Particularly, because graphite is a relatively weak material, the graphite threads of the impeller are easily stripped upon shaft rotation.

Even when the two components to be connected are of the same material, such as the base and riser of a pump for processing molten zinc or molten magnesium, there are connection problems. For example, the use of bolts and fasteners as a connecting mechanism do not provide optimal strength.

A third problem with known molten material pumps is that the pump components are often manufactured with clearances, tolerances, etc. which permit molten materials to escape from the cavity or housing of the base member. Because the pressure outside the base member is much less than that within the base member, the molten materials naturally gravitate toward the crevices created by the clearances and tolerances. Accordingly it is difficult to maintain an effective seal within the base member's housing.

A fourth problem associated with the foregoing molten material pumps is that the shafts of these pumps have a tendency to grow in length at elevated temperatures due to thermal expansion. The increased length often pushes the pump out of alignment. Similarly, the riser can bend or move during operation and push the pump out of alignment.

Accordingly, a need exists in the art of processing molten materials to provide a molten material pump having an improved (1) sealing assembly, (2) self-aligning shaft, (3) shaft-to-impeller connection, (4) impeller design, and (5) connection assembly for other pump components.

SUMMARY OF THE INVENTION

In accordance with one aspect of the present invention, a molten material pump includes a base member defining a chamber within which an impeller is disposed. A rotatable shaft is operatively connected to the impeller. The rotatable shaft has a first end and a second end. The second end of the shaft has a non-circular shape dimensioned to mate with a cooperating non-circular shaped opening in the impeller. A motor is operatively connected to the rotatable shaft for driving the rotatable shaft.

In accordance with another aspect of the present invention, a connecting assembly for interconnecting components of a molten material pump includes a first mounting member connected to a first pump component. The first mounting member has a shape configured to fit within a cooperating recess of a second mounting member connected to a second pump component. The first mounting member includes a first upper dimension and a second lower dimension configured to mate with a first upper dimension and a second lower dimension respectively of the cooperating recess. The first mounting member and cooperating recess of the second mounting member are shaped to form a locking relationship between the second lower dimension of the first mounting member and the first upper dimension of the cooperating recess.

In accordance with another aspect of the present invention, an impeller for a molten material pump includes a substantially cylindrical body having an upper surface, a lower surface, and a peripheral sidewall. A plurality of passages extend through the body of the impeller. A plurality of grooves are defined in the peripheral sidewall of the impeller body.

In accordance with another aspect of the present invention a molten material pump includes a base member defining a chamber housing an impeller. A rotatable shaft has an upper shaft portion connected to a motor and a lower stub shaft connected to the impeller. The lower stub shaft is not rigidly connected to the upper shaft portion so that the stub shaft is free to move in an axial direction.

In accordance with another aspect of the present invention a molten material pump includes a base member defining a chamber housing an impeller. A pump seal member is disposed on a top surface of the base member. The pump further includes a rotatable shaft having a first end connected to a driving means and a second end connected to the impeller. A deflector plate is operatively connected to the rotatable shaft and disposed on top of the pump seal. The deflector plate is sufficiently weighted to compress the seal member against the base member. In a preferred embodiment, the deflector plate is at least 9.921 kilograms (4.5 pounds).

In accordance with another aspect of the present invention, 10 an impeller for a molten material processing system includes a body having an upper surface, a lower surface and a peripheral sidewall. A plurality of passages extend through the body of the impeller for receiving a molten material. A non-circular shaped opening extends axially into the body of the impeller for receiving an associated shaft.

In accordance with another aspect of the present invention, a rotatable shaft for a molten material processing system includes an elongated member having a first end attachable to a motor and a second end attachable to an impeller. The second end of the elongated member has a non-circular shape.

In accordance with another aspect of the present invention, a connecting assembly for interconnecting components of a molten material pump includes a first mounting member connected to a first pump component. The first mounting member includes a shape configured to slidingly engage a cooperating recess of a second mounting member connected to a second pump component. The first mounting member and cooperating recess are shaped to form a locking relationship therebetween.

In accordance with another aspect of the present invention, an impeller/rotatable shaft assembly for a molten material pump includes an elongated shaft member having a first end attachable to a motor and a second end attachable to an impeller. The second end of the elongated member has a circular shape. The assembly further includes an impeller body having an upper surface, a lower surface and a peripheral sidewall. A circular opening extends axially into the body of the impeller for receiving the circular second end of the elongated shaft member. The circular opening and circular second end of the elongated shaft member are concentric and share a central axis. The central axis is offset from an axis of rotation of the elongated shaft.

One advantage of the present invention is the provision of an improved connection assembly between components of a molten material pump, for example between a base member and a post and/or riser.

Another advantage of the present invention is the provision of an improved connection between an impeller and a rotating shaft of a molten material pump.

Another advantage of the present invention is the provision of an impeller having grooves machined into its peripheral surface which enhances the sealing characteristics of a pump assembly.

Another advantage of the present invention is the provision of a deflector plate which weighs on and enhances the sealing characteristics of the pump sealing assembly.

Yet another advantage of the present invention resides in the ability of the molten material pump to maintain effective operation and alignment after thermal expansion of the rotating shaft has occurred.

Still another advantage of the present invention resides in the ability of the molten material pump to maintain proper alignment upon bending or movement of the support riser during operation.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several embodiments of which will be described in detail in this specification and illustrated in the accompanying drawings which form a part hereof and wherein.

DETAILED DESCRIPTION OF A PREFERRED EMBODIMENT

Reference will now be made in detail to the present preferred embodiments of the invention, examples of which are illustrated in the accompanying drawings. While the invention will be described in connection with the preferred embodiments, it will be understood that it is not intended to limit the invention to those embodiments. On the contrary, it is intended to cover all alternatives, modifications and equivalents that may be included within the spirit and scope of the invention defined by the appended claims.

Figure 1:
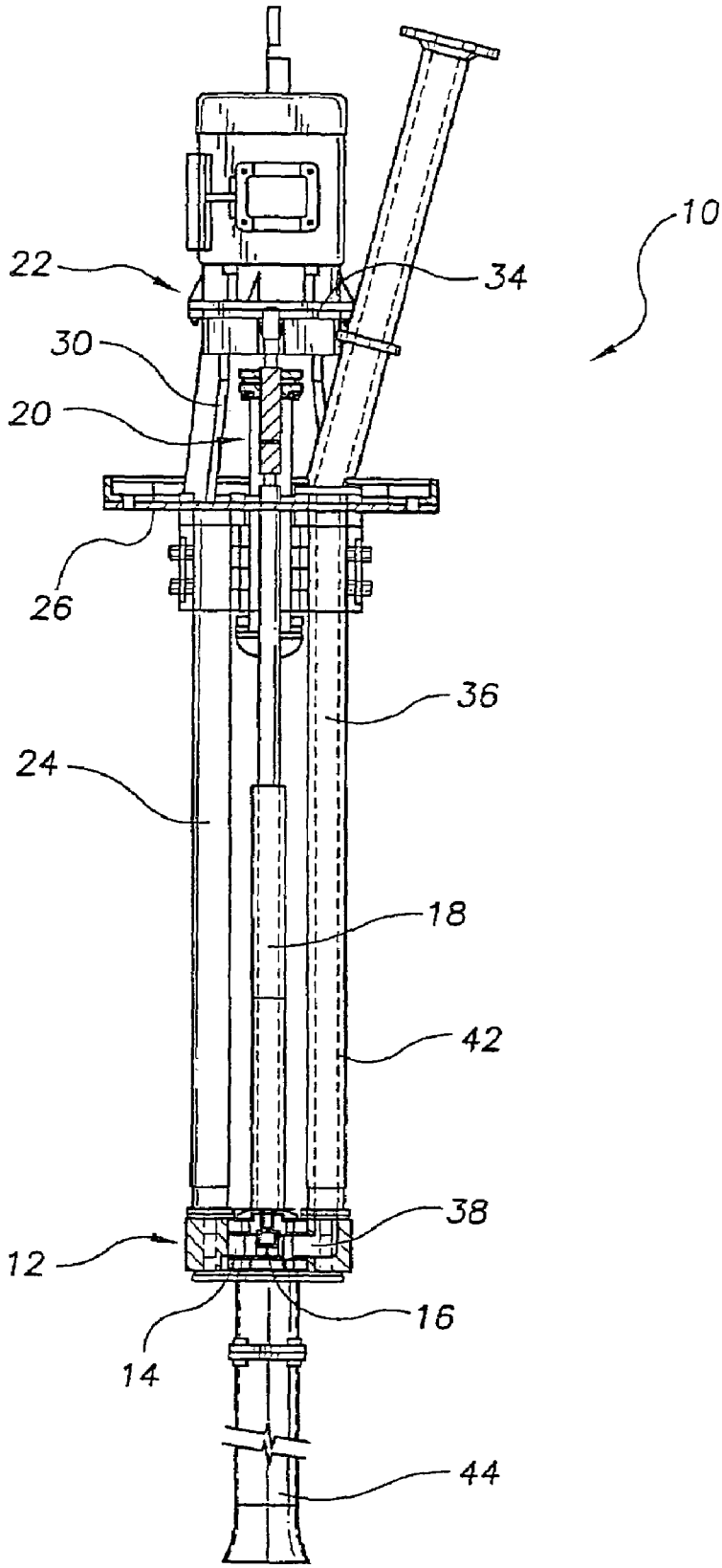
FIG. 1 is a cross-sectional view of a molten material pump.

Referring now to FIG. 1, a typical molten material pump is indicated generally by the reference numeral 10. The pump is adapted to be immersed in a molten material contained within a vessel (not shown). The vessel can be any container holding a molten material. Although a transfer pump is depicted, it should be understood that the pump can be any type of pump suitable for pumping molten materials, such as a circulation pump or gas injection pump. Generally, however, the pump will have a base member 12 defining a chamber 14 within which an impeller 16 is disposed. The impeller is supported for rotation within the base member by means of an elongated, rotatable shaft 18. A coupling assembly 20 connects the upper end of the shaft to a motor 22 which can be of any desired type, for example air or electric.

The pump is supported by at least one post 24 which extends from the base member 12 to a support plate 26. The post is shown mounted to the support plate via a standard nut/bolt connection. However, any suitable connection is acceptable. The motor 22 is positioned above the support plate 26 and is supported by struts 30 and a motor support platform 34. In the case of a molten material transfer pump, a riser 36 extends from the base member to the support plate 26 much in the same manner as the post 24. A molten material is pumped from the impeller 16, through a discharge opening 38 of the base member 12, and into a channel 42 defined in the riser 36. It must be understood, however, that a riser having a channel defined therein is not necessary for all pumps. For example, in circulation pumps and gas injection pumps, the riser may be replaced with posts similar to post 24, and the molten material simply discharges radially from base member 12.

The pump may optionally include an inlet tube or pipe 44 connected to a lower surface of the base member. Such a tube is provided when a molten material is being pumped from below the base member 12 and it is desired to minimize the length of the pump. Rather than providing a longer pump, it is often less expensive to attach an inlet pipe to the base member in order to achieve a deeper inlet drawing zone.

Figure 2:
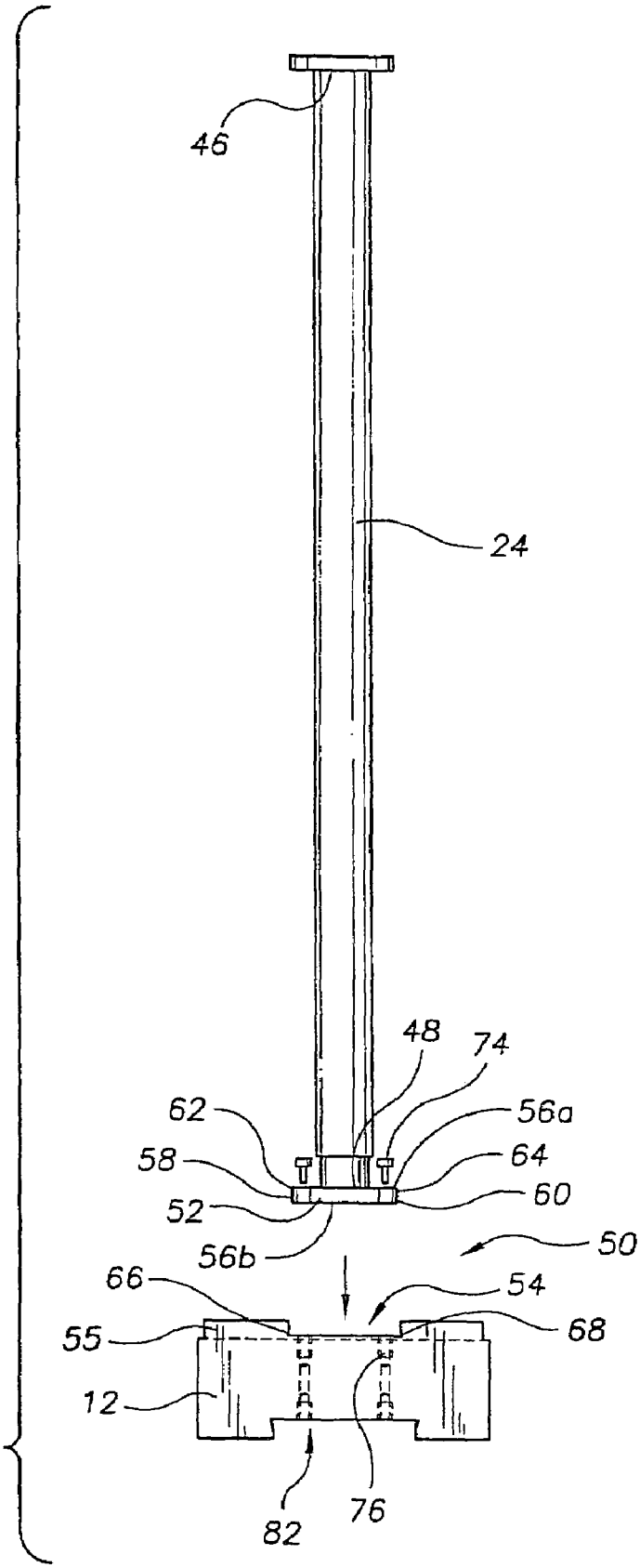
FIG. 2 is a plan view of a connecting assembly in accordance with the present invention.

With reference also to FIG. 2, the post 24 includes a first upper end 46 and a second lower end 48 and is preferably made from a metallic material, such as an iron based alloy or steel. A metallic material is preferred since it is generally stronger per pound than other materials. A problem with using a metallic material for the post is that the base member 12 is typically constructed from a refractory material, such as graphite or ceramic, in order to withstand the harsh conditions encountered while immersed in a molten material. Because graphite and metallic components experience different thermal expansion at elevated temperatures, it is difficult to maintain a connection between a graphite base member and a metallic shaft. Other pump components that are to be connected experience similar problems. In fact, even when the pump components to be connected are of the same material, standard bolts may not demonstrate an adequate connection strength at elevated temperatures.

Accordingly, the present invention provides a connecting assembly 50 which has excellent strength at elevated temperatures and effectively connects a first pump component to a second pump component. For example, the post 24 (which is the first pump component) includes a first mounting member 52 having a shape configured to fit securely within a cooperating recess 54 of a second mounting member 55 attached to the base member 12 (the second pump component). Alternatively, the second mounting member 55 may be integrally formed in the base member rather than being defined in a mounting member attached to the base (e.g. see recess 82 of FIG. 2). The first mounting member and cooperating recess of the second mounting member are shaped to form a locking relationship therebetween (as will be more fully described in connection with FIGS. 3 and 4). Although the post and base member are identified as the first and second pump components in this embodiment, it must be understood that the first and second pump components may be any other pump components that are to be connected.

Figure 3:
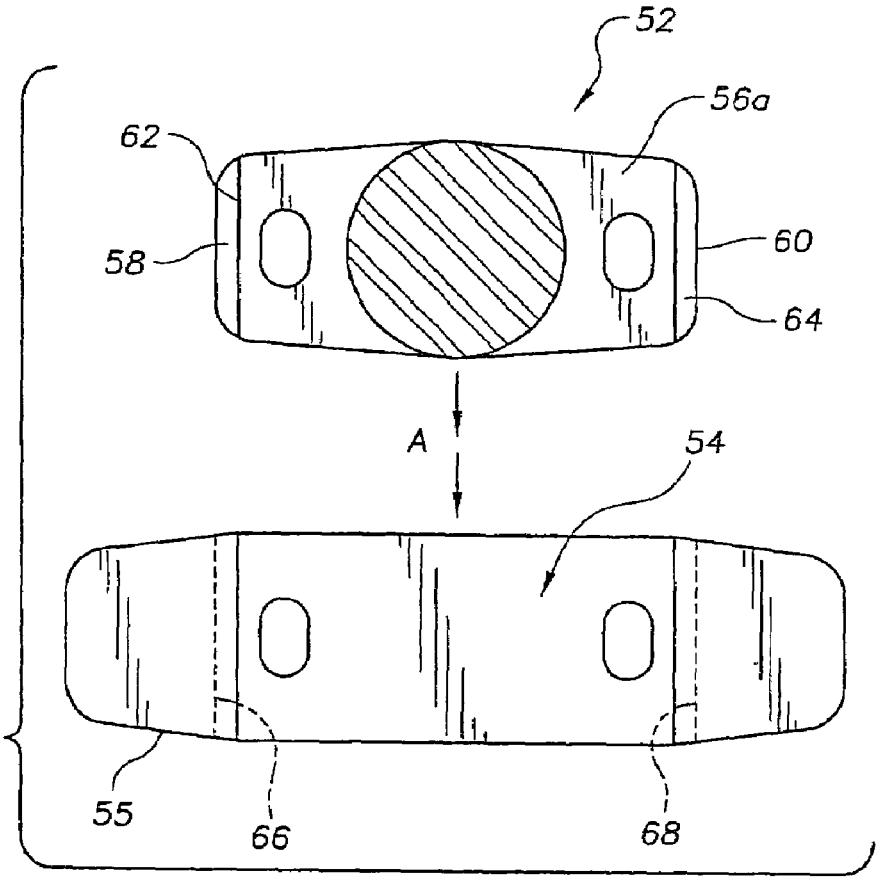
FIG. 3 is a top cross sectional view of a shaft having a mounting member connected thereto in accordance with the present invention.

With further reference to FIG. 3, the first mounting member 52 may be a rectangular disk-shaped member having an upper face 56*a* and a lower face 56*b*. In a preferred embodiment, the first mounting member includes tapered portions 58, 60 which are angled outwardly in a downward direction from an intermediate portion of the first mounting member's opposed sidewalls 62, 64. Preferably, the tapered portions are inserted into cooperating grooves 66, 68 of recess 54. A portion of the second mounting member projects over the grooves and, therefore, the tapered portions of the first mounting member when in place, prevent the first mounting member from being moved in the axial direction, thus forming the locking relationship. The first mounting member preferably has a shape slightly smaller than the shape of the cooperating recess in order to account for thermal expansion.

Although the first mounting member may be received into recess 54 in any suitable manner, it preferably slidingly engages recess 54. More specifically, recess 54 extends transversely across an entire top surface of the second mounting member as shown in FIG. 3. This enables the first mounting member to slide into recess 54 in the direction of arrows A. Alternatively, recess 54 does not extend entirely across the second mounting member. In such an embodiment, the first mounting member is dropped into recess 54 and rotated until tapered portions 58 and 60 engage grooves 66 and 68.

Figure 4:
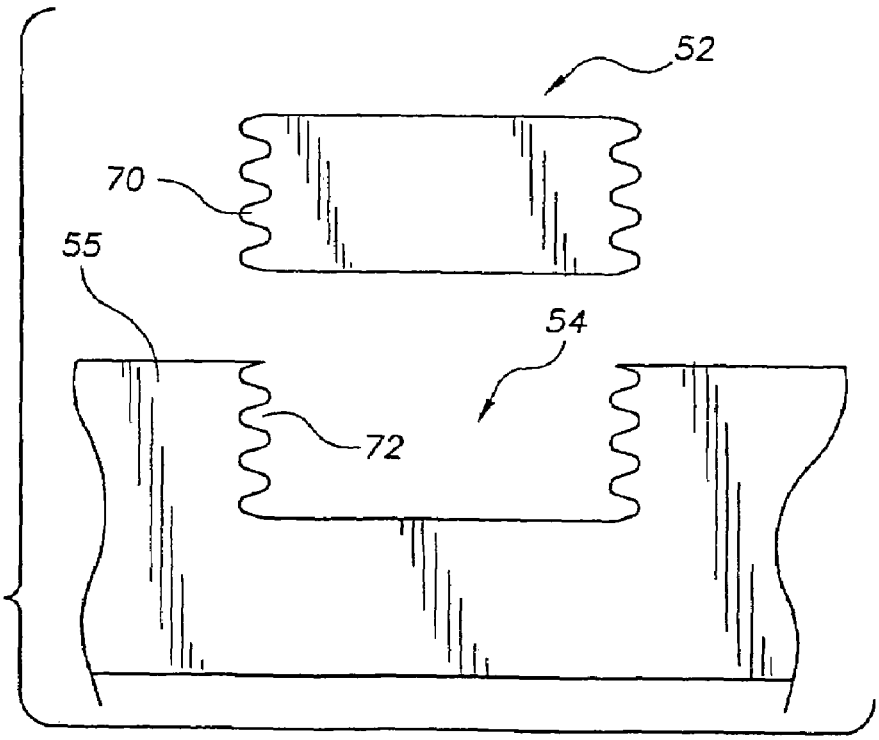
FIG. 4 is a plan view of an alternate embodiment of a mounting member and cooperating recess.

It is important to note that the shape of the first mounting member 52 and recess 54 is not limited to that described above. Rather, the present invention contemplates a mounting member and recess having any shape which adequately achieves an axial locking relationship between the first mounting member and the recess of the second mounting member. For example, FIG. 4 shows an alternate embodiment of the first mounting member 52 and recess 54 of the second mounting member. In this embodiment, the first mounting member includes several ridges 70 which are dimensioned to be received by a plurality of grooves 72 projecting into recess 54.

Returning to FIG. 2, fasteners 74 extend through openings in the first mounting member and are received in passages 76 extending through the second mounting member and into the base member 12. The fasteners prevent the first mounting member from moving transversely within the recess. When the base member, or other suitable pump component, is formed from a graphite material, the studs are preferably made from a carbon composite so that the thermal expansion of the fastener more closely matches that of the graphite component. However, if both pump components to be connected are made from a metallic material, the fasteners are also preferably made from a metallic material.

Figure 5:
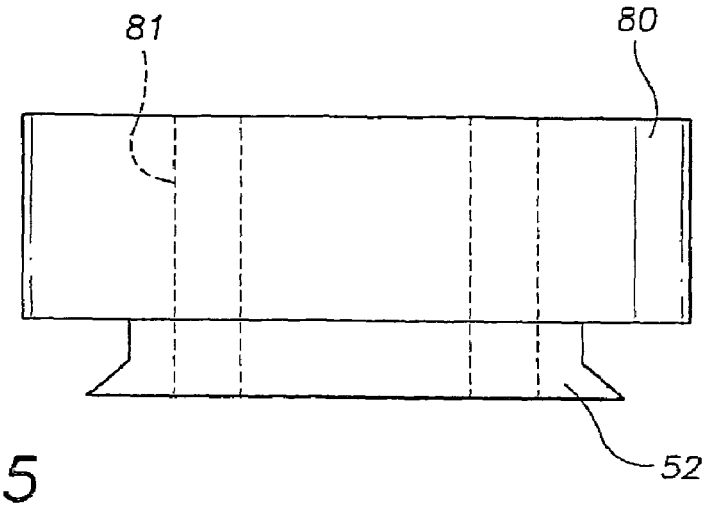
FIG. 5 is a plan view of an alternate embodiment of a mounting member.

With reference also to FIG. 5, pump components, such as posts and risers, typically include a flange or mounting piece 80 attached to one of its ends. The mounting piece enables the pump component to be coupled to another pump component, generally via fasteners extending through passages 81 in the mounting piece. In this embodiment, the first mounting member 52 is attached to a lower surface of mounting piece 80. By doing so, the connecting assembly of the present invention can be incorporated into existing pump components that do not already have the connecting assembly of the present invention.

The foregoing connecting assembly 50 has been described in connection with a post and base member merely for the purpose of example. However, as noted above, the connection assembly is equally suitable for interconnecting other pump components. For example, the riser 36 is also preferably connected to the base member using the described connection assembly. Moreover, the connecting assembly can be used to connect extension pieces to posts and/or risers. Furthermore, another recess 82 can be provided in the underside of the base member (see FIG. 2) to receive a mounting member of the inlet pipe 44 shown in FIG. 1. Accordingly, the connecting assembly is not limited to a post/base connection.

Figure 6A:
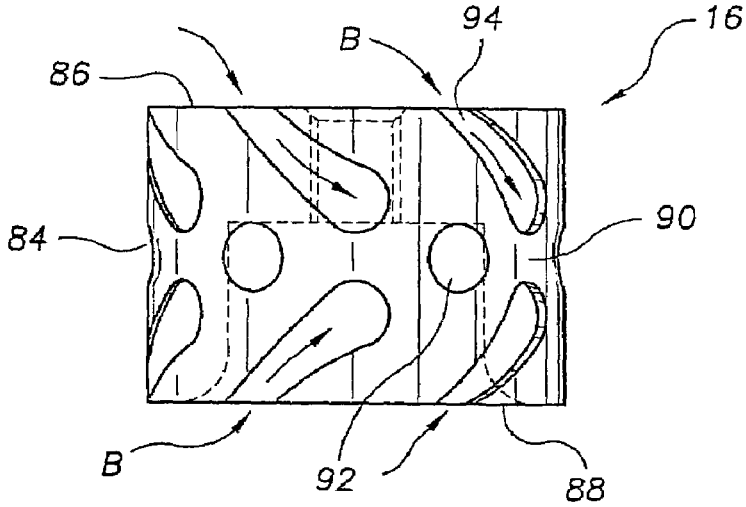
FIG. 6*a* is a side view of an impeller in accordance with the present invention.
Figure 6B:
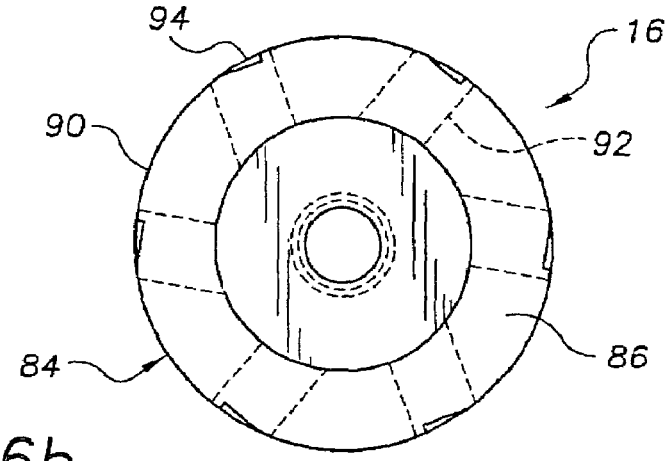
FIG. 6*b* is a top view of the impeller shown in FIG. 6*a;*

With reference to FIGS. 6*a* and 6*b*, the impeller 16 preferably includes a cylindrical body 84 having an upper surface 86, a lower surface 88, and a peripheral sidewall 90. A plurality of passages 92 extend through the body of the impeller. In the base members pumping chamber 14, high pressure areas are created by the rotating impeller. Accordingly, the molten material within the chamber will try to escape through spaces to the lower pressure outside of the base member.

To minimize molten material leakage, the peripheral sidewall 90 of the impeller preferably includes slots or grooves 94 defined therein. The grooves extend from an intermediate portion of the impeller sidewall to upper and lower edges of the impeller sidewall. The depth of the grooves for an impeller having a diameter of 9.525 centimeters (3 ¾ inches) is preferably in the range of 0.08-0.3175 centimeters (1/32-⅛ inches). The width of the grooves for this particular impeller is preferably in the range of 0.3175-1.27 centimeters (⅛-½ inches). However, it must be appreciated that the depth and width of the grooves of the impeller are not limited to those ranges cited above. The depth and width of these grooves will depend largely on the size of the impeller and the liquid being pumped.

Starting at the intermediate portion of the impeller sidewall, the grooves are preferably angled forward relative to the direction of rotation of the impeller. The forwardly angled grooves capture the molten material and pull it back into the base members pumping chamber (in the direction of arrows B) by creating an inlet pressure which counteracts the leakage pressure. In essence, a fluid seal is created which facilitates higher flow rates and pressures in the pump.

Alternatively, the grooves 94 can be angled backwards relative to the direction of rotation of the impeller. Such a configuration will facilitate leakage of the fluid being processed. Such a result is beneficial during cleaning of the bearing surfaces or when processing a fluid having a relatively large amount of solid particles, such as a granular material.

Figure 7A:
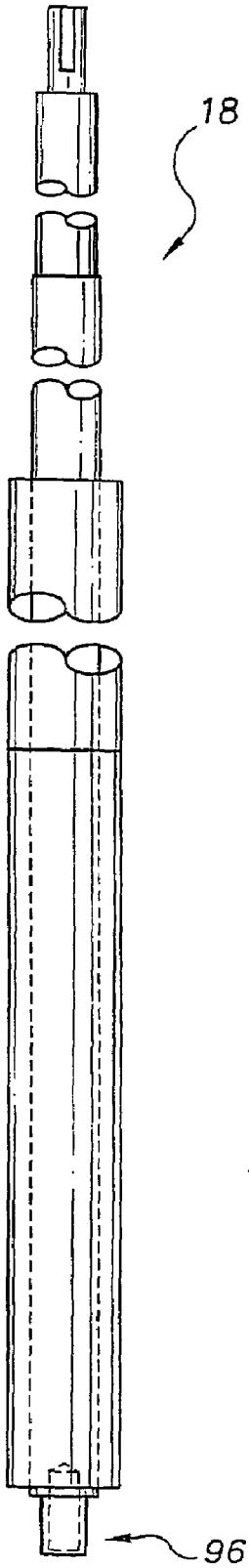
FIG. 7*a* is a side view of a shaft in accordance with the present invention.
Figure 7B:
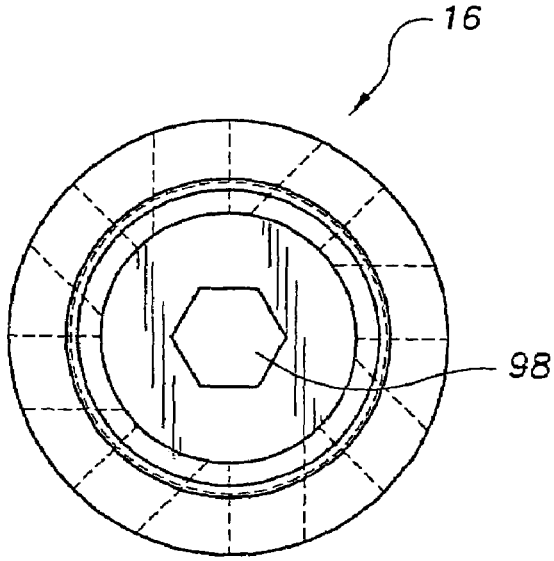
FIG. 7*b* is a top view of an impeller in accordance with the present invention.
Figure 7C:
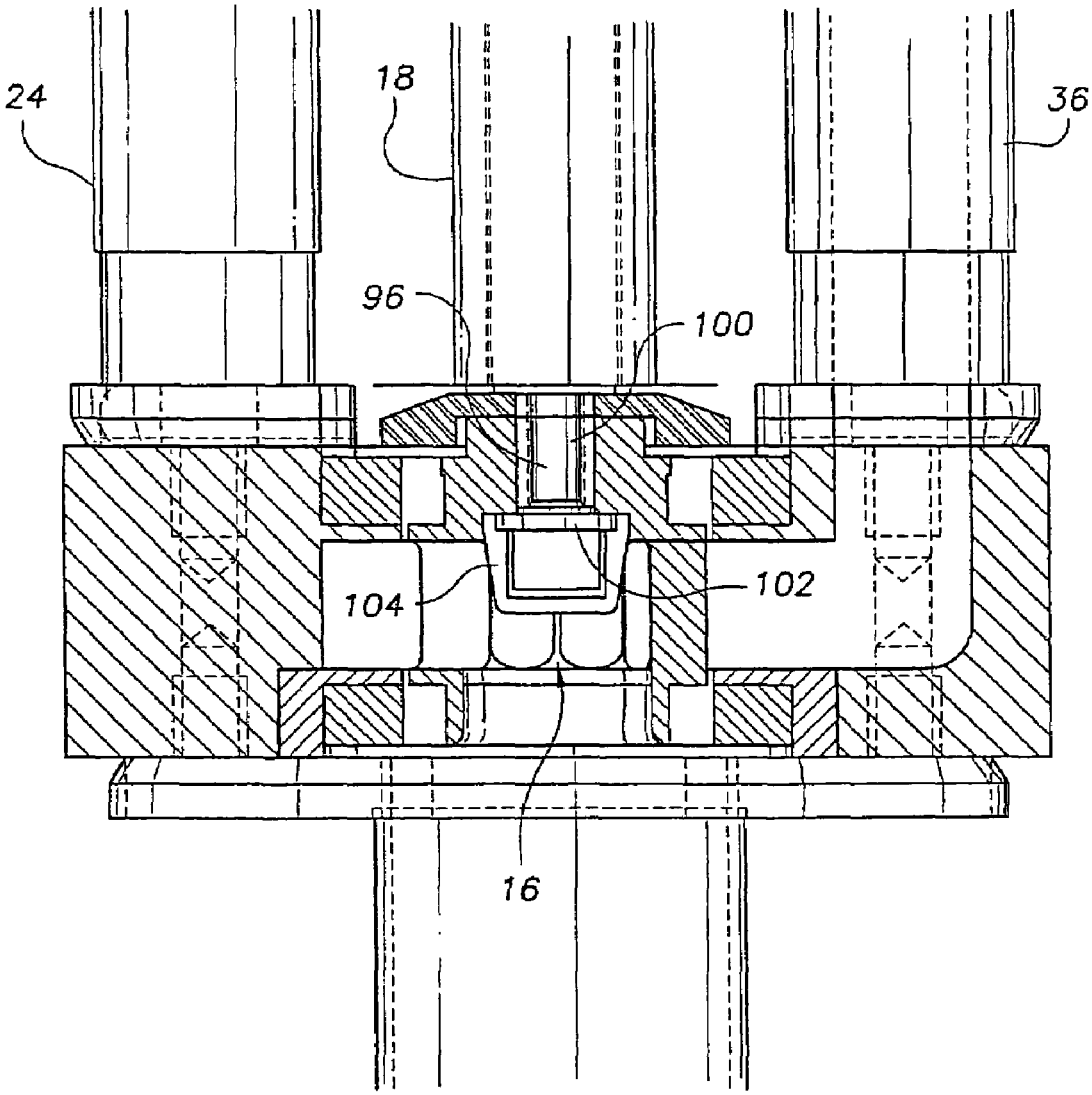
FIG. 7*c* is a cross-sectional view of a molten material pump in accordance with the present invention.

Turning now to FIGS. 7*a*-7*c*, a first lower end 96 of the rotatable shaft 18 has a non-circular shape dimensioned to fit within a cooperating non-circular opening 98 defined in the impeller. In a preferred embodiment, the lower end of the shaft and impeller opening have a polygonal shape. In a most preferred embodiment, the lower end of the shaft and impeller are in the shape of a hexagon. However, other suitable shapes, such as a square, oval, ellipse, etc., are within the scope and intent of the present invention. A threaded bolt 100 and washer 102 (see FIG. 7*c*) are provided for attaching the impeller to the shaft and preventing the impeller from slipping out of the impeller's opening. The bolt and washer are covered by a graphite cap 104 to prevent the bolt and washer from corroding in hostile, high temperature molten material environments. In a configuration wherein the impeller opening and shaft are polygonal shaped, the driving force is provided by the corners of the polygonal shaped shaft.

In conventional pumps, the shaft is round and includes a male member dimensioned to be threaded into a female receiving portion of a graphite impeller. However, particularly during rotation of a metal shaft, the shaft's male member will strip the graphite threads in the impeller's female member, since graphite is a relatively weak material. In the present invention, the polygonal shaped shaft 18 is fitted within the cooperating polygonal shaped opening 98 in the impeller.

Figure 7D:
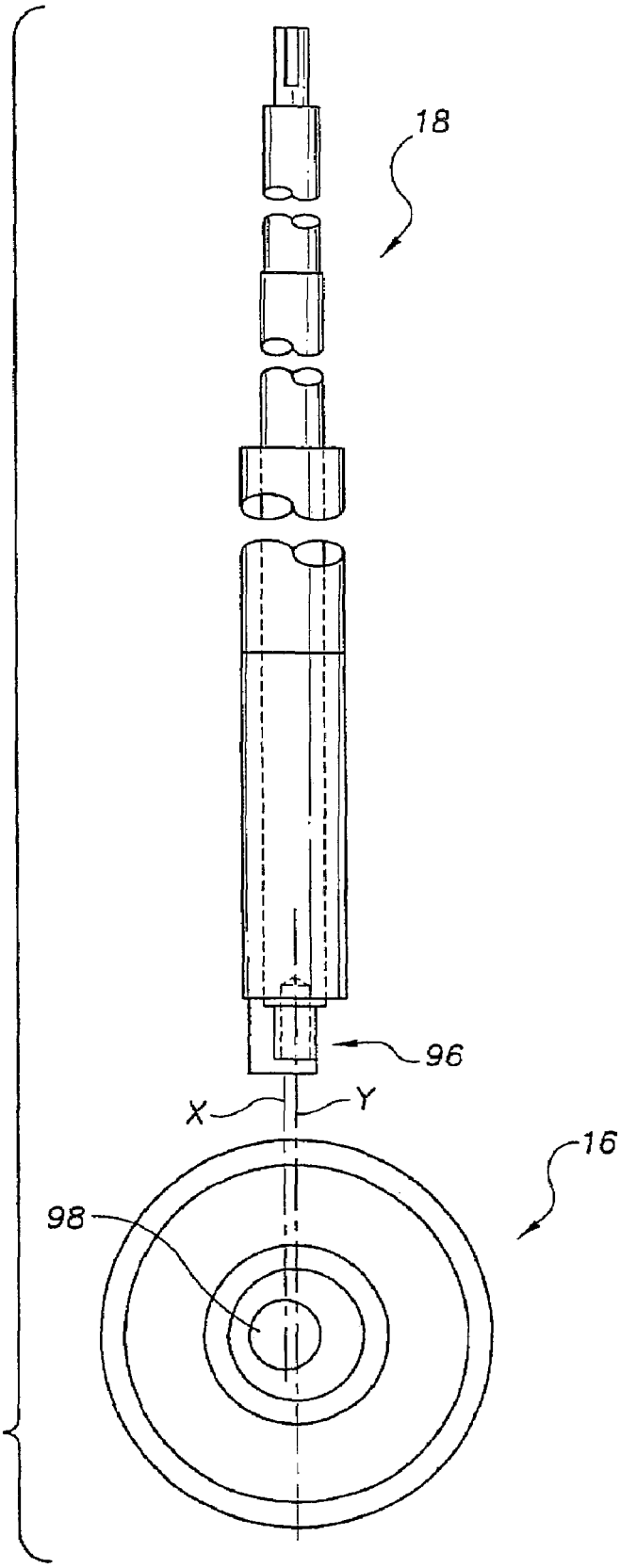
FIG. 7*d* is a plan view of an alternate embodiment of a shaft/impeller assembly in accordance with the present invention.

In an alternate embodiment, (see FIG. 7*d*), the opening 98 in the impeller 16 and the lower end 96 of the rotatable shaft 18 are in the shape of a circle or other rounded configuration such as an oval. The circular impeller opening 98 and the circular lower end 96 of the rotatable shaft are concentric and share the same central axis X. However, the axis of rotation Y of the rotatable shaft is different or offset from axis X. Accordingly, the shaft's lower end drives the impeller in a cam-like manner.

Figure 8A:
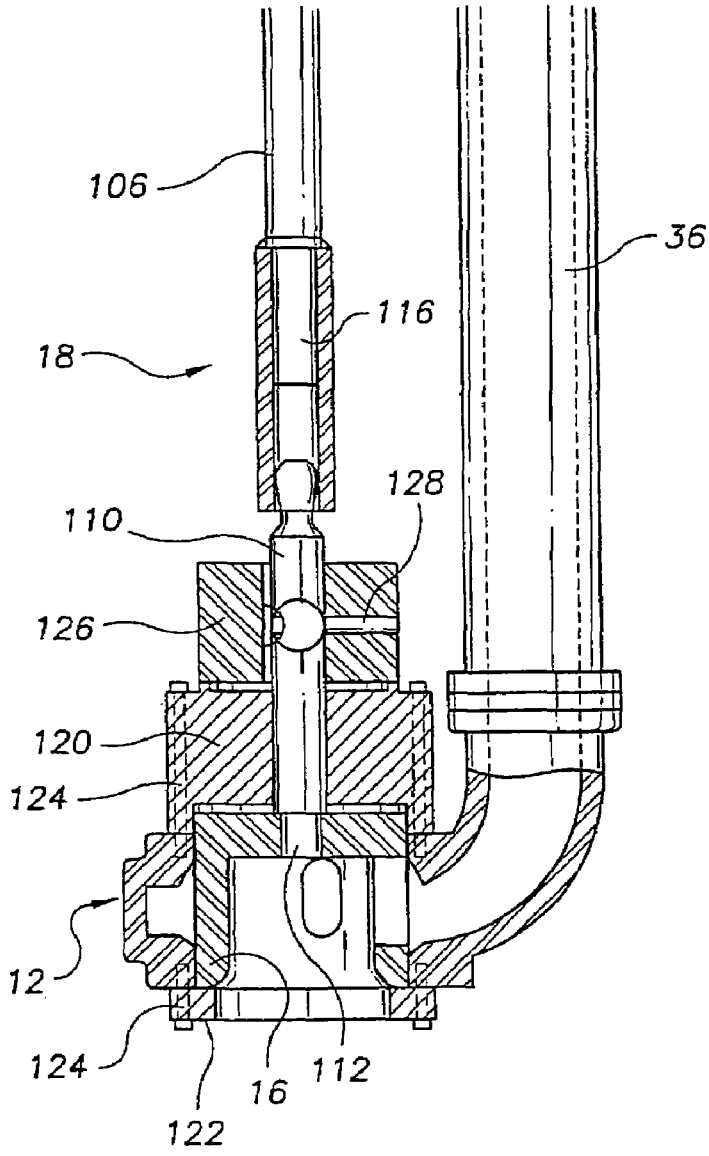
FIG. 8*a* is a cross-sectional view of a portion of a molten material pump in accordance with another embodiment of the present invention.
Figure 8B:
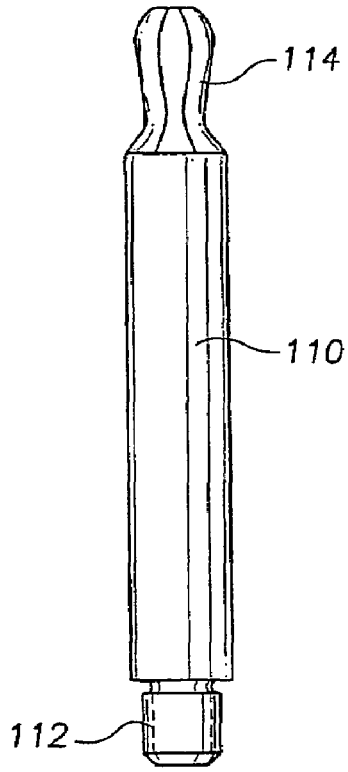
FIG. 8*b* is a plan view of a stub shaft in accordance with the embodiment shown in FIG. 8A.
Figure 8C:
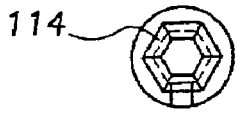
FIG. 8*c* is a top view of the stub shaft shown in FIG. 8B.

With reference to FIGS. 8*a*-8*c*, an alternate embodiment of the present invention is shown wherein like numerals represent like components and new numerals identify new components. In this embodiment, the rotatable shaft 18 of the pump includes an upper shaft portion 106 and lower stub shaft 110. A lower end 112 of the stub shaft is dimensioned to be received within an opening defined in the impeller. The lower end of the stub shaft and opening in the impeller are preferably polygonal shaped and most preferably hexagonal shaped.

An upper end of the stub shaft preferably includes a universal joint 114 dimensioned to be received within a sleeve 116 of the upper shaft portion. The universal joint preferably takes the shape of a ball-hex (see FIGS. 8*b* and 8*c*) and fits within sleeve 116 in a ball and socket manner. Accordingly, the universal joint enables the stub shaft and impeller assembly to pivot. Moreover, the universal joint is not rigidly connected within the sleeve and, thus, the impeller and stub shaft are free to move in the axial direction. Although a ball-hex is shown, any other suitable shape can be used to provide a pivotable universal joint.

Providing a non-rigid or loose connection in the middle of the rotatable shaft allows the upper and lower portions of the shaft to grow in length, as a result of thermal expansion, without affecting operation of the pump. As the length of the stub shaft grows, the increased length can be accommodated within sleeve 114. Similarly, as the length of the sleeve grows, the sleeve can slide over the upper end of the stub shaft. Moreover, if the posts 24 and/or risers 36 distort due to high temperatures and try to push the pump out of alignment, the universal joint permits the impeller to maintain ideal alignment. Furthermore, if the riser bends or moves during operation, the pump will continue to operate properly since the universal joint will enable the stub shaft to pivot.

With specific reference to FIG. 8*a*, the pump includes a sealing assembly having a first upper pump seal 120 and a second lower pump seal 122. The upper seal is preferably a block-like member while the lower pump seal is preferably a plate-like member. In a preferred embodiment, both the upper and lower seals are made from a graphite material and are connected to the base member via studs 124. Generally, the upper and lower seals are manufactured with bearing clearances which permit molten material leakage.

In the present invention, a floating deflector plate 126 is disposed on top of the upper sealing block to minimize molten material leakage. The deflector plate is preferably made from a cast iron material and is initially free to move axially along the stub shaft 110. When placed on the upper sealing block, the deflector plate is heavy enough to push or squeeze the sealing surfaces together, thereby minimizing molten material leakage. In this embodiment, the deflector plate preferably weighs at least 9.921 kilograms (4.5 pounds). However, any suitable weight is contemplated by the present invention. Once the deflector plate has been appropriately positioned, a set screw (not shown) is fastened through a key hole 128 defined in the deflector plate. Accordingly, the deflector plate is rigidly mounted to the stub shaft so that it will rotate with the impeller 16.

Thus, it is apparent that there has been provided, in accordance with the present invention, a molten material pump system that fully satisfies the objects, aims and advantages set forth above. While the invention has been described in conjunction with specific embodiments thereof, it is evident that many alternatives, modifications, and variations will be apparent to those skilled in the art. In light of the foregoing description, accordingly, it is intended to embrace all such alternatives modifications, and variations as fall within the spirit and broad scope of the appended claims.

We claim:

1. A connecting assembly for interconnecting components of a molten material pump comprising a first mounting member connected to a first pump component and having a shape configured to fit within a cooperating recess of a second mounting member of a second pump component, the first mounting member including a first upper dimension and a second lower dimension configured to mate with a first upper dimension and a second tower dimension respectively of the cooperating recess, the first mounting member and cooperating recess of the second mounting member being shaped to form an axial locking relationship between the second lower dimension of the first mounting member and the first upper dimension of the cooperating recess and at least one fastening element extending through an opening in the first mounting member and into the second pump component to prevent lateral movement of the first mounting member within the recess in the second mounting member.

2. The connecting assembly according to claim 1, wherein the first pump component is a post and the second pump component is a base member.

3. The connecting assembly according to claim 1, wherein the first pump component is a post and the second pump component is a base member.

4. The connecting assembly according to claim 1, wherein the first pump component is a riser and the second component is a base member.

5. The connecting assembly according to claim 1, wherein the first pump component is comprised of a metallic material and the second pump component is comprised of a refractory material.

6. The connecting assembly according to claim 1, wherein the first mounting member includes tapered portions on opposed sidewalls configured to be received within cooperating grooves defined in the second mounting member.

7. A connecting assembly for interconnecting components of a molten material pump comprising a first mounting member connected to a first pump component and having a shape configured to slidingly engage a cooperating recess of a second mounting member connected to a second pump component, the first mounting member and the cooperating recess being shaped to form an axial locking relationship therebetween and at least one fastening element extending through an opening in the first mounting member and into the second pump component to prevent lateral movement of the first mounting member within the recess in the second mounting member.

8. The connecting assembly according to claim 7, wherein the second mounting member is integrally formed in the second pump component.

* * * * *